US006685028B1

(12) United States Patent
Olsen

(10) Patent No.: US 6,685,028 B1
(45) Date of Patent: Feb. 3, 2004

(54) SCREENING EQUIPMENT

(75) Inventor: Peter Martin Olsen, Toronto (AU)

(73) Assignee: Weatherford Australia Pty. Limited, Malaga (AU)

( * ) Notice: Subject to any disclaimer, the term of this patent is extended or adjusted under 35 U.S.C. 154(b) by 0 days.

(21) Appl. No.: 10/009,970

(22) PCT Filed: May 1, 2000

(86) PCT No.: PCT/AU00/00400

§ 371 (c)(1),
(2), (4) Date: Nov. 1, 2001

(87) PCT Pub. No.: WO00/66281

PCT Pub. Date: Nov. 9, 2000

(30) Foreign Application Priority Data

May 3, 1999 (AU) ..... PQ0129

(51) Int. Cl.[7] ..... B07B 1/48

(52) U.S. Cl. ..... 209/405; 209/397; 209/399; 209/379

(58) Field of Search ..... 209/379, 381, 209/382, 399, 397, 405

(56) References Cited

U.S. PATENT DOCUMENTS

| | | | | |
|---|---|---|---|---|
| 8,601 A | * | 12/1851 | Wheeler | 209/397 |
| 23,641 A | * | 4/1859 | Fitts | 209/397 X |
| 5,876,552 A | | 3/1999 | Bakula | 209/403 X |
| 6,006,923 A | * | 12/1999 | Helmy et al. | 209/399 X |
| 6,253,926 B1 | * | 7/2001 | Woodgate | 209/399 |

FOREIGN PATENT DOCUMENTS

| | | |
|---|---|---|
| AU | 81139/87 | 1/1989 |
| AU | 77626/94 | 5/1995 |
| AU | 731011 | 12/1998 |
| AU | 97218 | 3/1999 |
| EP | 0 081 471 | 6/1983 |
| EP | 167999 | 7/1984 |
| RU | 2119833 | 7/1993 |

* cited by examiner

*Primary Examiner*—Donald P. Walsh
*Assistant Examiner*—Kaitlin Joerger
(74) *Attorney, Agent, or Firm*—Fish & Richardson P.C.

(57) ABSTRACT

A screening panel assembly (10) includes a frame (12) on which a screening panel (14) is supported. The frame (12) has frame members and intermediate members with the panel (14) being secured only to the frame members of the frame (12).

3 Claims, 2 Drawing Sheets

SCREENING EQUIPMENT

FIELD OF THE INVENTION

This invention relates to screening equipment. More particularly, the invention relates to a screening panel assembly and to a component for a screening panel assembly.

SUMMARY OF THE INVENTION

According to a first aspect of the invention, there is provided a screening panel assembly which includes a support structure having a plurality of peripheral support members and intermediate support members, the intermediate support members extending between the peripheral support members; and a screening panel having a plurality of openings defined through it, the openings being of a size which determines a discriminating capacity of the panel and the panel being secured only to certain of the peripheral support members of the support structure and being unsecured with respect to the intermediate support members to facilitate flexing of the panel in a direction normal to a plane of the panel.

Normally, in use, the screening panel assembly is arranged substantially horizontally and material to be screened flows over the panel of the assembly.

The support structure may include a frame with the peripheral support members being a pair of transversely spaced, longitudinal support members (when viewed in a direction of flow of the material over the panel assembly) and a pair of longitudinally spaced, transverse support members, the intermediate support members extending between at least one of the pair of longitudinal support members and the pair of transverse support members. Preferably, the intermediate support members extend parallel to the longitudinal members, between the transverse members.

The panel may be secured to at least one of the pair of longitudinal support members and the pair of transverse support members and rests on the intermediate support members.

In a preferred embodiment of the invention, the panel is secured only to the longitudinal support members and, optionally the transverse support members of the frame. Then, the panel is not secured to the intermediate support members to facilitate flexing of the panel in a direction normal to the plane of the panel, in use.

The panel and the support structure may be of a resiliently flexible material. Thus, both the panel and the support structure may be of a synthetic plastics material such as polyurethane.

Preferably, the panel and the support structure are moulded. The panel may be bonded to the support structure.

For improving the rigidity of the support structure, at least certain, and preferably all, of the support members of the support structure may contain reinforcing elements.

The openings in the panel may be in the form of slots extending in a direction of flow of material over the panel, in use, each slot having a major, longer axis extending in the direction of flow of the material. Each slot may be substantially boomerang-shaped or chevron shaped and the slots may be arranged in rows with each row having an interrupted saw-tooth wave pattern in the panel extending in a direction of flow of the material.

The slots in each row may be oriented in the same direction such that apices or "elbows" of the slots point in the same direction. The slots in one row may be staggered with respect to the slots in an adjacent row and the slots in said one row may have their apices pointing in an opposite direction to the slots in the adjacent row.

Each slot may flare outwardly from an operatively top surface to a bottom surface of the panel.

According to a second aspect of the invention, there is provided a component for a screening panel assembly, the component including a screening panel having a plurality of generally boomerang-shaped or arcuate openings defined through it.

The openings may be in the form of slots extending, in use, in a direction of flow of material over the panel, each slot having a major, longer axis extending in the direction of flow of the material. The slots may be arranged in rows in the panel with each row having an interrupted saw-tooth wave pattern extending, in use, in a direction of flow of the material.

The slots in each row may be oriented in the same direction such that apices or "elbows" of the slots point in the same direction.

The slots in one row may be staggered with respect to the slots in an adjacent row and the slots in said one row may have their apices pointing in an opposite direction to the slots in the adjacent row.

Each slot may flare outwardly from an operatively top surface to a bottom surface of the screening panel.

BRIEF DESCRIPTION OF THE DRAWINGS

The invention will now be described by way of example with reference to the accompanying drawings in which.

SPECIFIC DESCRIPTION OF THE PREFERRED EMBODIMENT

Figure 1:
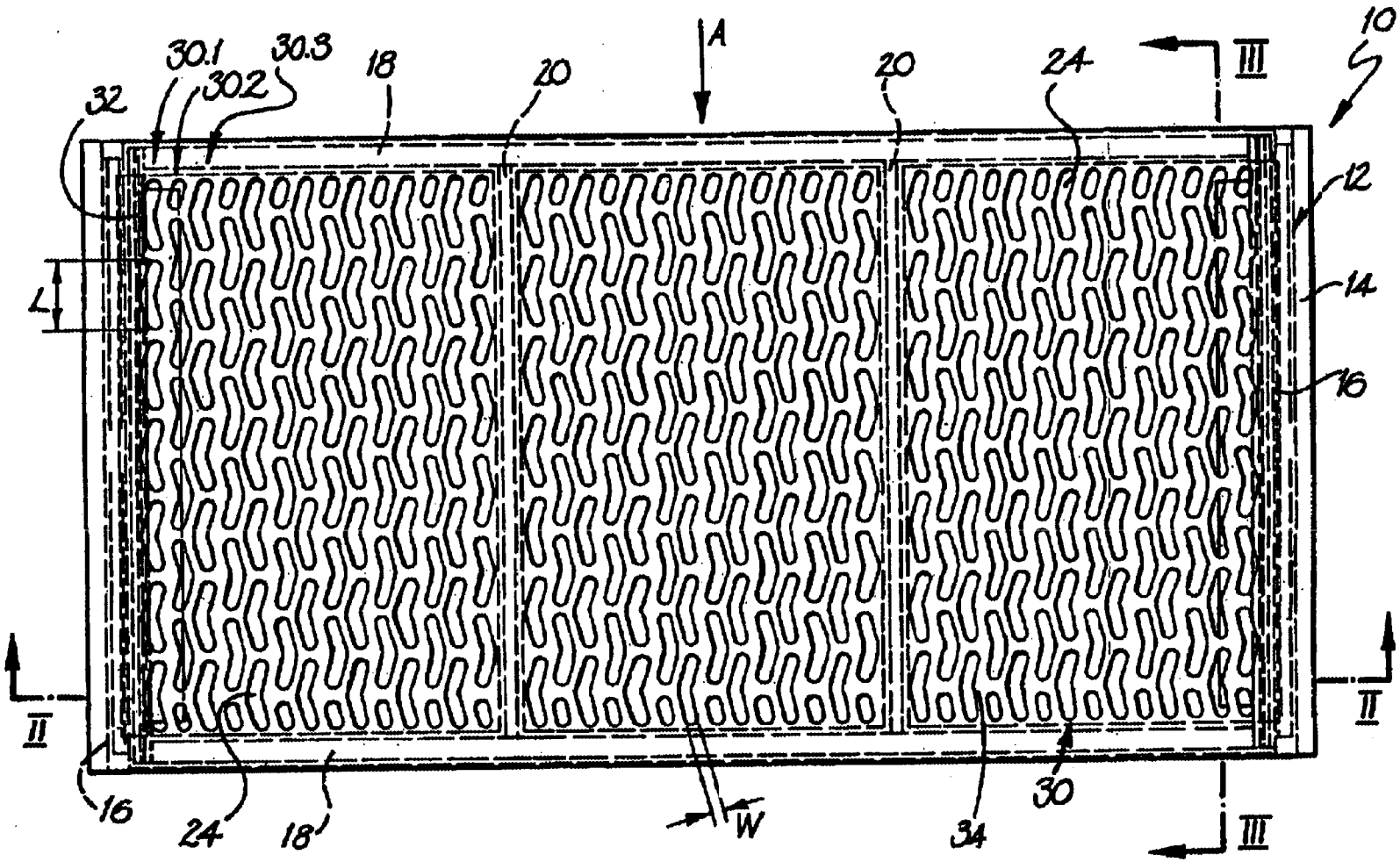
FIG. 1 shows a plan view of a screening panel assembly, in accordance with the invention.

In the drawings, reference numeral 10 generally designates a screening panel assembly in accordance with the invention. The assembly 10 includes a support structure in the form of a frame 12 on which a screening panel 14 is supported. Both the frame 12 and the panel 14 are of a synthetic plastics material, such as polyurethane.

The frame 12 and the panel 14 are both moulded or cast and the panel 14 is bonded to the frame 12 for use.

The frame 12 comprises a pair of transversely spaced, longitudinal members 16 and a pair of longitudinally spaced, transverse members 18. In addition, the frame 12 comprises a plurality of intermediate support members or struts 20 extending parallel to the longitudinal members 16 and between the transverse members 18. Thus, the struts 20 support the span of the panel 14 and the panel 14 rests thereon, in use.

However, the panel 14 is bonded only to the frame members 16 and 18 and is not bonded to the struts 20. In other words, the panel 14 only rests on the struts 20 and is not secured in any way to the struts 20.

The members 16 and 18 and the struts 20 of the frame 12 include reinforcing elements 22 therein to improve the rigidity of the frame 12.

The panel 14 has openings or slots 24 defined through it from an operatively top surface 26 to a bottom surface 28 of the panel 14.

Each slot 24 is substantially boomerang-shaped having a major axis or length dimension L extending parallel to a direction of flow of material over the assembly 10, as illustrated by arrow A in FIG. 1. Further, the slots 24 are arranged in rows 30. The slots 24 in each row 30 have their apices or "elbows" 32 pointing in the same direction. Further, the slots 24 in one row 30.1 have their "elbows" 32 pointing in an opposite direction to the slots 24 in an adjacent row 30.2. The slots 24 in the row 30.2 are offset or staggered with respect to the slots 24 in the adjacent rows 30.1 and 30.3.

Figure 2:
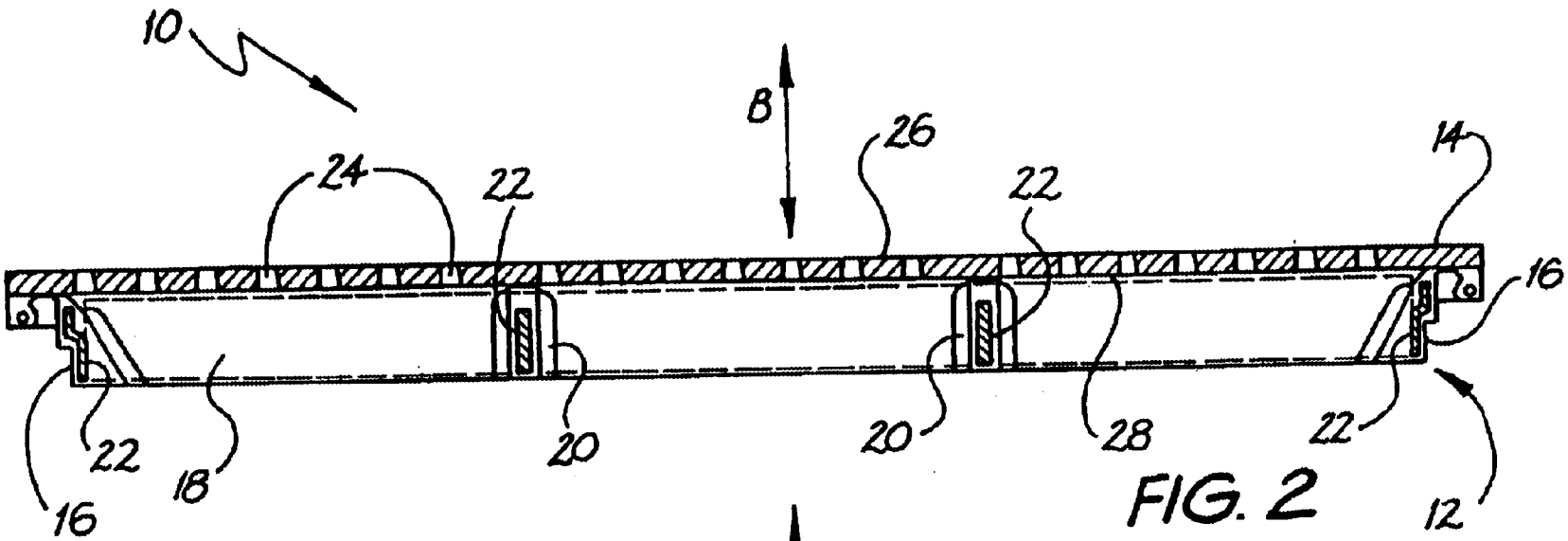
FIG. 2 shows a sectional side view of the assembly taken along line II—II in FIG. 1.
Figure 3:
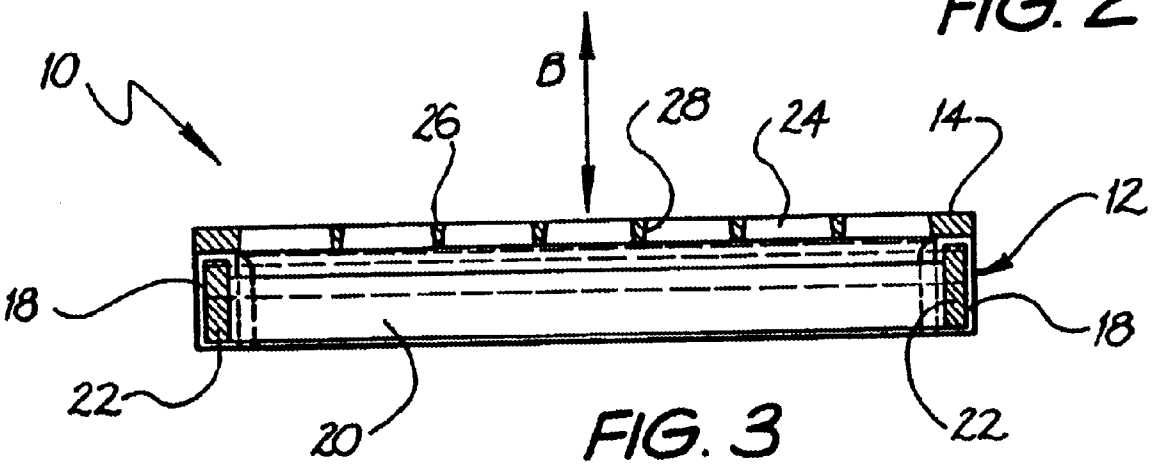
FIG. 3 shows a sectional end view of the assembly taken along line III—III in FIG. 1.

Due to the fact that the panel 14 is unsecured with respect to the struts 20 of the frame 12, when the assembly 10 is operated in use and is caused to vibrate, the panel 14 reciprocates in the direction of arrows B (FIGS. 2 and 3). Each time the panel 14 comes into contact with the struts 20, it is jolted which assists in displacing material which may have lodged in the slots 24. Due to the presence of bridging material 34 between adjacent slots 24 in each row 30, the panel 14 is sufficiently rigid to inhibit the passage of oversized material through the assembly 10.

It is to be noted that each slot 24 has a width dimension W which is selected to determine the discriminating capacity of the panel 14 of the assembly 10. It is also to be noted that each row 30 of slots 24 effectively forms an interrupted sawtooth wave-like pattern of a predetermined amplitude and wavelength.

The amplitude and wavelength of the wave pattern of each row 30 is selected in dependence on the required use of the assembly 10.

In addition, the shape of each slot 24 inhibits the likelihood of elongate oversized particles passing through the slots 24.

It is also to be noted in FIGS. 2 and 3 of the drawings that the slots 24 taper or flare outwardly from the top surface 26 to the bottom surface 28 of the panel 14 to enhance the passage of material through the panel 14 and to inhibit blockage or blinding of the slots 24 by the material.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A component for a screening panel assembly, the component including a screening panel having a plurality of generally boomerang-shaped openings defined through it, the openings being in the form of slots arranged in rows with each row having an interrupted saw-tooth pattern extending, in use, in a direction of flow of material over the panel, each slot having a major, longer axis extending in the direction of flow of the material, the slots in one row being staggered with respect to the slots in an adjacent row and the slots in said one row having their apices pointing in an opposite direction to the slots in the adjacent row.

2. The component as claimed in claim 1 in which the slots in each row are oriented in the same direction such that apices of the slots point in the same direction.

3. The component as claimed in claim 1 in which each slot flares outwardly from an operatively top surface to a bottom surface of the screening panel.

* * * * *